US007378209B2

(12) United States Patent
Suwa et al.

(10) Patent No.: US 7,378,209 B2
(45) Date of Patent: May 27, 2008

(54) TONER FOR ELECTROPHOTOGRAPHY AND METHOD FOR FORMING IMAGE USING THE SAME

(75) Inventors: Yoshihito Suwa, Shizuoka (JP); Toru Nakamura, Abiko (JP)

(73) Assignees: Tomoegawa Paper Co., Ltd., Tokyo (JP); Ticona GmbH, Kelsterbach (DE)

( * ) Notice: Subject to any disclaimer, the term of this patent is extended or adjusted under 35 U.S.C. 154(b) by 443 days.

(21) Appl. No.: 10/529,623

(22) PCT Filed: Sep. 18, 2003

(86) PCT No.: PCT/JP03/11875

§ 371 (c)(1),
(2), (4) Date: Mar. 30, 2005

(87) PCT Pub. No.: WO2004/031864

PCT Pub. Date: Apr. 15, 2004

(65) Prior Publication Data

US 2005/0271962 A1 Dec. 8, 2005

(30) Foreign Application Priority Data

Sep. 30, 2002 (JP) ..... 2002-286510

(51) Int. Cl.
*G03G 9/087* (2006.01)

(52) U.S. Cl. ..... 430/109.3; 430/108.4; 430/124.1

(58) Field of Classification Search ..... 430/109.3, 430/108.4, 124.1
See application file for complete search history.

(56) References Cited

U.S. PATENT DOCUMENTS

| | | | | |
|---|---|---|---|---|
| 5,870,661 | A * | 2/1999 | Menzel et al. | 399/400 |
| 6,210,852 | B1 | 4/2001 | Nakamura | |
| 2003/0118930 | A1* | 6/2003 | Suwa et al. | 430/108.8 |
| 2003/0165764 | A1* | 9/2003 | Suwa et al. | 430/109.4 |

FOREIGN PATENT DOCUMENTS

| | | | |
|---|---|---|---|
| EP | 0 978 766 | A1 | 2/2000 |
| EP | 1 300 729 | A2 | 4/2003 |
| JP | 02-221967 | | 9/1990 |
| JP | 05-9223 | | 1/1993 |
| JP | 05-339327 | | 12/1993 |
| JP | 06-67460 | | 3/1994 |
| JP | 06-271628 | | 9/1994 |
| JP | 09-101631 | | 4/1997 |
| JP | 10-010781 | | 1/1998 |
| JP | 10-142838 | | 5/1998 |
| JP | 10-268573 | | 10/1998 |
| JP | 11-106571 | | 4/1999 |
| JP | 2984404 | | 9/1999 |
| JP | 2000-66438 | | 3/2000 |
| JP | 2000-108223 | | 4/2000 |
| JP | 2000-153530 | | 6/2000 |
| JP | 2000-206732 | | 7/2000 |
| JP | 2000-275905 | | 10/2000 |
| JP | 2000-284528 | | 10/2000 |
| JP | 2001-075307 | | 3/2001 |
| JP | 2001-272816 | | 10/2001 |
| JP | 2001-305792 | | 11/2001 |
| JP | 3261166 | | 12/2001 |
| JP | 2002-196535 | | 7/2002 |
| WO | WO 01/18290 | A1 | 3/2001 |

* cited by examiner

*Primary Examiner*—John L Goodrow
(74) *Attorney, Agent, or Firm*—Knobbe Martens Olson & Bear LLP

(57) ABSTRACT

An electrophotographic toner used for an image forming method that utilizes a heat-pressure type fuser equipped with a fusing member having a surface layer containing polybenzimidazole, wherein the toner comprises at least cycloolefin copolymer resins as binder resins. The cycloolefin copolymer resins comprise a mixture of 0 to 75 percent by weight of a low molecular weight component having a weight-average molecular weight of less than 15000, 5 to 25 percent by weight of a medium molecular weight component having a weight-average molecular weight of 15000 to 100000, and 20 to 95 percent by weight of a high molecular weight component having a weight-average molecular weight of more than 100000.

17 Claims, 1 Drawing Sheet

TONER FOR ELECTROPHOTOGRAPHY AND METHOD FOR FORMING IMAGE USING THE SAME

This application is the U.S. National Phase under 35 U.S.C. §371 of International Application PCT/JP2003/011875, filed on Sep. 18, 2003, which claims priority of Japanese Patent Application No. 2002-286510, filed on Sep. 30, 2002. The International Application was published under PCT Article 21(2) in a language other than English.

TECHNICAL FIELD

This invention relate to an electrophotographic toner used in image forming devices such as copiers, printers and facsimiles employing electrophotographic technology, and an image forming method using the same.

BACKGROUND ART

Dry developers used for image development by image forming devices employing electrophotographic technology are generally classified into two-component developers consisting of a toner and a carrier made of ferrite powder, iron powder, glass beads, etc., magnetic single-component developers consisting of a toner containing magnetic powder, and non-magnetic single-component developers. Toners used in these developers are mainly made of binder resins and coloring agents, to which other materials are added including waxes that improve low-temperature fusing property onto a recording sheet and releasing property from the fusing member, charge control agents that add polarity (positive or negative electric charge), etc. After these materials are mixed at the prescribed ratios, they are made into toner of powder form by the process of melting, kneading, pulverizing, classifying, etc. Finally, surface treatment is done with external additives, such as silica, titanium oxide, alumina, resin fine particles, etc. for the purpose of controlling fluidity, charging property, cleaning property, storage stability, etc., to obtain the final developer.

Mainstream toner binder resins include styrene-acrylate resins and polyester resins. However, toners using styrene-acrylate resins have low fracture strength and are therefore easy to generate fine powder dust, despite offering good environmental resistance characteristics. On the other hand, toners using polyester resins have high fracture strength and do not generate fine powder dust easily, but their environmental resistance characteristics are poor.

The developers currently available on the market are naturally manufactured with due consideration to human and environmental safety, and pose no problem in their practical use. However, one trend seen in developers of late is the selection of materials that are safer to the human body and environment. It has become particularly essential to select binder resins, which account for a majority of the toner composition, by considering safety and environment from the viewpoints of component monomers, residual solvents, and so on. In this climate, the suitability of cycloolefin copolymer resins as toner binder resins is drawing the attention of late, and toners using cycloolefin copolymer resins are already disclosed in Publications of Unexamined Japanese Patent Application Nos. Hei 9-101631, 2000-284528 and 2000-206732. These resins consist of non-toxic monomers and provide a lower specific gravity and higher intrinsic volume resistance compared with styrene-acrylate resins and polyester resins, thus offering excellent development property and transfer property (transfer efficiency) and enabling more sheets to be printed per unit weight (less toner consumption). Furthermore, cycloolefin copolymer resins provide high facture strength, so they can extend the life of developers. Also, their excellent optical transparency makes these resins suitable for use in full-color toners.

On the other hand, heat-pressure fusing system has become the mainstream technology adopted by fusers that fuse a developer onto recording media, in line with the trend for higher copying speeds. In this method, a transfer paper is passed between a fusing member contacting toner and a pressure roll not contacting toner, and then heat and pressure are applied simultaneously to melt and fuse the toner onto the transfer paper. Many of the fusing members adopting this method are rolls incorporating a heat source, but belts made of heat-resistant film, etc., are also used. On the other hand, the member not contacting toner generally consists of a pressure roll. To prevent molten toner from adhering to the surface of the fusing member during the toner fusing process, substances providing good releasing property with respect to binder resins such as styrene-acrylate resins and polyesters are selected to form the surface of the fusing member. In particular, excellent releasing property is required for the fusing member contacting toner. Representative examples of these substances offering releasing property are polytetrafluoroethylene (may also be referred to as "PTFE" hereinafter) and silicone rubber. However, these substances offer low heat resistance and therefore the allowable surface temperature of the fusing member cannot be set high or maintaining the surface temperature to a certain level is difficult. As a result, the toner fusing speed cannot be raised and this has been limiting how much the copying speed could be increased.

In addition, toners containing cycloolefin copolymer resins as binder resins tend to cause a so-called "wrapping" phenomenon, in which the toner, even when release agents are added, prevents the printed surface from separating from the fusing member and consequently causes the paper to wrap around the fusing member. This occurs when a normal heat-pressure type fuser, where the fusing member surface and pressure roll surface adopt a combination of PTFE/silicone or silicone/silicone (top/reverse sides of the printed paper), is used. This problem can be improved by reducing the low molecular weight component of cycloolefin copolymer resins, but this measure also reduces the fusing property at low temperature and therefore does not provide the best solution. For this reason, the problem of wrapping has not been fully resolved. Additionally, cycloolefin copolymer resins have a very strong compatibility with polypropylenes, polyethylenes and natural waxes used in common toner binder resins such as styrene-acrylate resins and polyester resins, and therefore cannot provide sufficient releasing property from the fusing member even when release agents are added. Furthermore, cycloolefin copolymer resins are strong and thus cause the surface of the fusing member to wear easily.

On the other hand, copiers and printers sold in recent years are using fewer consumable parts to improve maintainability. As a result, the number of members that cannot be replaced by the user is increasing, and the fusing member is one of such members. Parts not replaceable by the user must remain trouble-free for a long period, but fusers are prone to occur problems. Frequent occurrences of the aforementioned wrapping and other problems add burdens to the user and also require replacement of the problem member by a service provider, which results in downtime during daily operating hours.

SUMMARY OF THE INVENTION

In view of the above, the purpose of the present invention is to provide an electrophotographic toner using cycloolefin copolymer resins as binder resins, which offers good development property by preventing offset or wrapping during the fusing process, even when many sheets are printed continuously, while maintaining sufficient image density and other desired characteristics for a long period, provides excellent transfer efficiency and durability and reduces toner consumption, and to provide an image forming method using the same. The present invention also aims to provide an electrophotographic toner also suitable for full-color imaging, and an image forming method using the same.

The electrophotographic toner proposed by the present invention is designed for use with an image forming method that utilizes a heat-pressure type fuser equipped with a fusing member having a surface layer containing polybenzimidazole (PBI-containing surface layer), where such toner is characterized by containing at least cycloolefin copolymer resins as binder resins.

The electrophotographic toner proposed by the present invention is also characterized by containing, as binder resins, cycloolefin copolymer resins comprising a mixture of 0 to 75 percent by weight of a low molecular weight component having a weight-average molecular weight of less than 15000, 5 to 25 percent by weight of a medium molecular weight component having a weight-average molecular weight of 15000 to 100000, and 20 to 95 percent by weight of a high molecular weight component having a weight-average molecular weight of more than 100000.

Also, the image forming method proposed by the present invention is characterized by the use of a toner containing at least cycloolefin copolymer resins as binder resins and the supplying of a transfer paper with a toner image formed by such toner to a heat-pressure type fuser equipped with a fusing member having a PBI-containing surface layer, thereby fusing such toner image onto the paper.

The image forming method proposed by the present invention is further characterized by the supplying to a heat-pressure type fuser of a transfer paper with a toner image formed by an electrophotographic toner that contains, as binder resins, cycloolefin copolymer resins comprising a mixture of 0 to 75 percent by weight of a low molecular weight component having a weight-average molecular weight of less than 15000, 5 to 25 percent by weight of a medium molecular weight component having a weight-average molecular weight of 15000 to 100000, and 20 to 95 percent by weight of a high molecular weight component having an average molecular weight of more than 100000, thereby fusing such toner image onto the paper.

The image forming method proposed by the present invention involves developing, transferring and fusing an electrostatic latent image formed by the electrophotographic method, wherein the development process can be performed using either a magnetic or non-magnetic single-component development process or two-component development process. When the image forming method of a single-component development process is used, the toner itself can be used as a developer. In the case of the image forming method of a two-component development process being used, a developer consisting of a toner and a carrier is used.

In the proposed invention, the electrophotographic toner used in the image forming method must contain at least cycloolefin copolymer resins. Also, a contact heat-pressure type fuser is used as a means for fusing the toner onto recording media such as a transfer paper. Here, a fuser whose fusing member has a surface layer containing polybenzimidazole (hereinafter referred to as "PBI") is particularly suitable. The fusing member may have a roll or belt shape. If the fusing member is provided as a roll, the PBI containing surface layer may be formed by way of coating or a seamless tube containing PBI may be fitted onto the roll. If the fusing member is provided as a belt, the surface layer containing PBI may be formed by way of coating or the belt itself may be made of a film containing PBI.

Use of the electrophotographic toner proposed by the present invention using cycloolefin copolymer resins as binder resins will prevent offset or wrapping during the fusing process, even when many sheets are printed continuously, and maintain sufficient image density and other desired characteristics for a long period, provided that an image forming method is used that utilizes a heat-pressure type fuser equipped with a fusing member having a PBI-containing surface layer. In addition, this toner provides other benefits such as excellent transfer efficiency and durability, reduced carrier contamination, reduced toner consumption, and no degradation of the fusing member.

DESCRIPTION OF THE SYMBOLS

Figure 1:
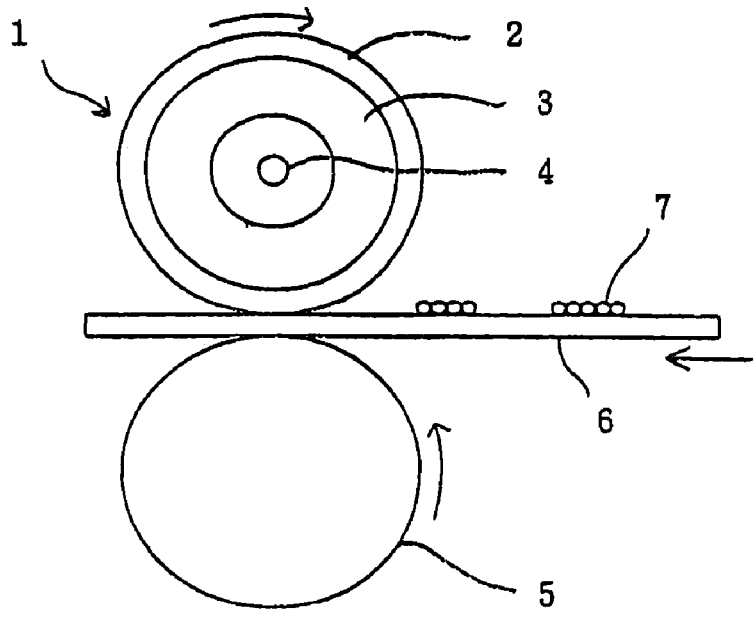
FIG. 1 provides a schematic diagram of a heat-pressure type fuser equipped with a roll-type fusing member, as used in the present invention.

1 - - - Fusing roll, 2 - - - PBI-containing surface layer, 3 - - - Aluminum core tube, 4 - - - Heat source, 5 - - - Pressure roll, 6 - - - Transfer paper, 7 - - - Toner image, 8 - - - Belt made of PBI film

BEST MODE FOR CARRYING OUT THE INVENTION

The following provide a detailed explanation of the toner proposed by the present invention, designed for use with the aforementioned image forming method.

The toner used in the present invention comprises at least toner particles, to which fluidizing agents, representative of which is hydrophobic silica, and other agents are added as necessary. Also, the toner particles comprise cycloolefin copolymer resins as binder resins, as well as other additives as may be deemed necessary, such as coloring agents, release agents and charge control agents.

The toner particles used in the present invention must contain at least cycloolefin copolymer resins as binder resins. Cycloolefin copolymer resins are polyolefin resins having a cyclic structure and provided, for example, as copolymers of ethylene, propylene, butylene and other α-olefins (acyclic olefins) with cyclohexene, norbornene, tetracyclododecene and other double-bonded cycloolefins, based on either random copolymerization or block copolymerization. These cycloolefin copolymer resins can be obtained, for example, through known polymerization methods using metallocene or Ziegler catalysts. For example, they can be synthesized using the methods disclosed in Publications of Unexamined Japanese Patent Application Nos. Hei 5-339327, Hei 5-9223 and Hei 6-271628.

The copolymerization ratio of α-olefins and cycloolefins in a cycloolefin copolymer resin can be adjusted over a wide range by way of setting different mol ratios of both materials to be charged so that desired copolymers can be obtained. To be specific, cycloolefins are set to account for 2 to 98 mol percent, or preferably 2.5 to 50 mol percent, or more preferably 2.5 to 35 mol percent, of the total of α-olefins and cycloolefins. For example, if ethylene and norbornene are reacted together as α-olefin and cycloolefin, respectively, the glass transition temperature (Tg) of the cycloolefin copolymer resin resulting from the reaction is affected significantly by the charge ratio of both materials, and increasing the percentage of norbornene will raise Tg. To be specific, adjusting the ratio of norbornene to approx. 60 percent by weight will result in a Tg of approx. 60 to 70° C.

In the present invention, only one cycloolefin copolymer resin obtained by the above polymerization method may be used, or two or more cycloolefin copolymer resins of different average molecular weights may be combined.

In the present invention, the aforementioned cycloolefin copolymer resins should preferably be provided as a mixture comprising 0 to 75 percent by weight of a low molecular weight component with a weight-average molecular weight (hereinafter referred to as "Mw") of less than 15000, 5 to 25 percent by weight of a medium molecular weight component with a Mw of 15000 to 100000, and 20 to 95 percent by weight of a high molecular weight component with a Mw of more than 100000. Particularly desirable is a mixture comprising 0 to 70 percent by weight of a low molecular weight component with a Mw of less than 15000, 10 to 20 percent by weight of a medium molecular weight component with a Mw of 15000 to 100000, and 20 to 95 percent by weight of a high molecular weight component with a Mw of more than 100000.

If the aforementioned low molecular weight component exceeds 75 percent by weight, offset and wrapping will occur easily at high temperature. If the aforementioned medium molecular weight component is less than 5 percent by weight, wrapping around the fusing member will occur and the non-offset temperature at high-temperature region will drop, and the compatibility of low molecular weight component and high molecular weight component will also drop easily. If the medium molecular weight component exceeds 25 percent by weight, uniform kneading property will drop and toner performance will be affected, and fusing property at low temperature will also drop. If the aforementioned high molecular weight component is less than 20 percent by weight, wrapping around the fusing member will occur and the non-offset temperature at high-temperature region will drop. If the high molecular weight component exceeds 95 percent by weight, uniform kneading property will drop and toner performance will be affected, and fusing property at low temperature will also drop.

If the cycloolefin copolymer resins in the present invention are provided as a mixture comprising three copolymers of different weight-average molecular weights as specified above, the Mw of the low molecular weight component should preferably be in a range of 5000 to 10000, or more preferably in a range of 6000 to 8000. The Mw of the medium molecular weight component should preferably be in a range of 50000 to 90000. The Mw of the high molecular weight component should preferably be 120000 or more.

Incidentally, in many cases the low molecular weight component comprises the main part of the binder resin and exhibits fusing property at low temperature. The medium molecular weight component is positioned between the low molecular weight component and high molecular weight component and provides the function to improve the compatibility of low molecular weight component and high molecular weight component. The high molecular weight component is effective in preventing high-temperature offset and wrapping around the fusing roll.

In the present invention, weight-average molecular weight is measured using the GPC method. The GPC method is explained as follows: specifically, tetrahydrofuran (THF) is fed at a flow rate of 1 ml/min through a column adjusted to a temperature of 40° C., and then a THF solution of the sample is injected to measure the molecular weight of the sample. Polystyrene is used as a standard substance, and the measured value is converted to polystyrene value.

In the present invention, the aforementioned cycloolefin copolymer resins may have carboxyl groups introduced using the melt air oxidization method or via maleic anhydride denaturation, acrylic acid denaturation, etc. This will improve the compatibility of cycloolefin copolymer resins with other resins and pigment dispersing property. The same effect can also be achieved by introducing hydroxyl groups or amino groups using known methods. In addition, fusing property can be improved by introducing cross-linking structures to cycloolefin copolymer resins by way of copolymerization with diene monomers such as norbornadiene, cyclohexadiene or tetracyclododecadiene or by adding metals such as zinc, copper or calcium to cycloolefin copolymer resins containing carboxyl groups.

Molecular weight distribution of cycloolefin copolymer resins in the toner is measured by the aforementioned GPC method after dissolving the toner in THF and then collecting a cycloolefin copolymer solution via centrifugal separation.

The cycloolefin copolymer resins used in the present invention should preferably contain a minimal amount of decalin, a solvent used in the manufacturing process. The concentration of decalin residues in toner particles should preferably be 500 ppm or less, or more preferably 300 ppm or less, of the toner particles. Since decalin is a solvent with a high boiling point, it easily remains in toner particles. If the decalin concentration exceeds 500 ppm, problems will occur such as lower charge controllability of toner, back ground fogging on printed images and odor generation during the fusing process.

The concentration of decalin residues in toner are measured by gas chromatography.

In the present invention, the binder resins may also contain other resins beside the aforementioned cycloolefin copolymer resins. In the present invention, the blending ratio of cycloolefin copolymer resins in binder resins is preferably 50 to 100 percent by weight, or more preferably 80 to 100 percent by weight. If cycloolefin copolymer resins account for less than 50 percent by weight, it will become difficult to provide a low-consumption electrophotographic toner that would maintain sufficient image density under all environments, produce no unwanted phenomena such as toner melt-contamination on the developing member or black spots (hereinafter referred to as "BS") due to filming onto the photoreceptor, and offer high development property and transfer property, during continuous copying of many sheets.

Other resins that can be used in combination with cycloolefin copolymer resins include polystyrene resins, polyacrylate resins, styrene-acrylate copolymer resins, styrene-methacrylate copolymer resins, polyvinyl chloride, polyvinyl acetate, polyvinylidene chloride, phenol resins, epoxy resins, polyester resins, hydrogenated rosin and cyclic rubber. In particular, to prevent wrapping during the toner fusing process, those resins that can raise the viscosity of toner in the melting process are preferred. Therefore, the melting start temperature (softening point) should preferably be high (such as 120 to 150° C.), and the glass transition temperature should be also high, such as 65° C. or more, in order to improve storage stability.

In the present invention, it is preferable to contain waxes in the toner to improve fusing property at low temperature and releasing property during the fusing process. It is particularly preferable when the molecular weight of cycloolefin copolymer resins is increased, because it will complement fusing property at low temperature. Appropriate waxes include: polyethylene waxes, polypropylene waxes and other polyolefin waxes; Fischer-Tropsch waxes and other synthetic waxes; paraffin waxes, micro-waxes and other petroleum waxes; and carnauba wax, candelilla wax, rice wax and hardened castor oil. Also, it is desirable to use a denaturated polyethylene waxes for the purpose of controlling the micro-dispersing of waxes in cycloolefin resins. Two or more of such waxes can also be used. The wax content should preferably be 0.5 to 10.0 percent by weight, or more preferably 1.0 to 8.0 percent by weight, of toner particles. If the wax content is less than 0.5 percent by weight, fusing property at low temperature and releasing property during the fusing process will not improve sufficiently. If the wax content exceeds 10.0 percent by weight, storage stability will be affected.

Multiple waxes can be used as necessary, but preferably all waxes should have a melting point of 80° C. or more as indicated by a DSC heat-absorption peak. If the melting point is less than 80° C., toner particles will easily cause blocking, thereby affecting durability.

As for coloring agents, one or more of the following pigments are used for the respective colors: carbon black and lamp black (black pigments); C.I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207 and 209, C.I. pigment violet 19, C.I. violet 1, 2, 10, 13, 15, 23, 29 and 35, etc. (magenta pigments); C.I. pigment blue 2, 3, 15, 16 and 17, C.I. Vat blue 6, C.I. acid blue 45, etc. (cyan pigments); and C.I. pigment yellow 1, 2, 3, 4, 5, 6, 7, 10, 11, 12, 13, 14, 15, 16, 17, 23, 65, 73, 74, 83, 97, 155 and 180, etc. (yellow pigments). Commonly used coloring agents are, in common names, carbon black, aniline blue, Chalcoil blue, chrome yellow, ultramarine blue, DuPont oil red, quinoline yellow, methylene blue chloride, phthalocyanine blue, malachite green oxalate, lamp black and rose bengale. Coloring agents must have a sufficient content required for forming visible images of sufficient density. For example, coloring agents should account for 1 to 20 weight parts, or preferably 1 to 7 weight parts, to 100 weight parts of binder resins.

The toner used in the present invention should preferably contain charge control agents as necessary. Charge control agents are added for the purpose of adding polarity, and classified into those used for positively charged toners and negatively charged toners. Charge control agents for positively charged toners include nigrosin dye, quaternary ammonium salt, pyridinium salt, azine, etc. Charge control agents for negatively charged toners include metal containing azo complexes, salicylic acid metal complexes and boron complexes. A preferred content of added charge control agents is 0.1 to 5 weight parts to 100 weight parts of binder resins. One or more of the above charge control agent can be used. In the present invention, charge control agents for full-color toners should preferably have no color. Colorless charge control agents include boron complexes, zinc complexes and chrome complexes. Among these, boron complexes given by the general formula below are preferable, and one representative product is LR-147 sold by Japan Carlit Co., Ltd. These boron complexes should preferably be contained by 1.0 to 4.0 percent by weight with respect to toner particles.

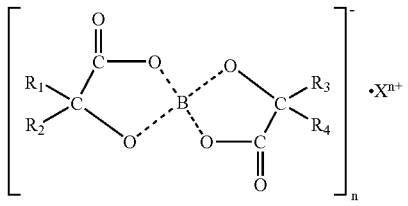

[In the formula, $R_1$ and $R_4$ indicate hydrogen atoms, alkyl groups or substituted or non-substituted aromatic rings (including fused rings), while $R_2$ and $R_3$ indicate substituted or non-substituted aromatic rings (including fused rings). B indicates boron and $X^{n+}$ indicates a cation, where n is either 1 or 2.]

Zinc complexes and chrome complexes can also be used in color toners, but they may affect chargeing stability. One probable reason for this is a high intrinsic volume resistance of cycloolefin copolymer resins compared with polyester resins, etc.

Other additives that may be added as necessary include magnetic powder, etc. Magnetic powder includes fine particles of ferrite powder, magnetite powder, iron powder, and so on. As ferrite powder, a mixed sintered material given by $MeO—Fe_2O_3$ is used in the present invention. Here, MeO refers to an oxide of Mn, Zn, Ni, Ba, Co, Cu, Li, Mg, Cr, Ca, V, etc., and one or more of these oxides can be used. As magnetite powder, a mixed sintered material given by $FeO—Fe_2O_3$ is used. The particle size of magnetic powder should preferably be 0.05 to 3 μm, and the content of magnetic powder in the toner should preferably be 70 percent by weight or less.

Toner particles comprising the toner used in the present invention can be produced by mixing the aforementioned materials at the prescribed ratios, melting and kneading the mixture, and then pulverizing, classifying, etc. Also, toner particles can be produced by processing the source substances of the aforementioned materials under the polymerization method. In general, the volume-average particle size of toner particles is set to a range of 5 to 15 μm.

The toner proposed by the present invention may have fine hydrophobic silica particles adhered by 0.5 to 3.0 percent by weight, or preferably 0.7 to 2.5 percent by weight, to toner particles. If the content of adhered fine hydrophobic silica particles is less than 0.5 percent by weight, the release agents contained in toner particles will easily melt-contaminate the photoreceptor or charging members and produce image defects. If the content of adhered fine hydrophobic silica particles exceeds 3.0 percent by weight, hydrophobic silica will easily detach and produce unwanted phenomena such as BS on the photosensitive member. Also, it is desirable to combine fine hydrophobic silica particles of large, medium and small particle sizes. By adopting an external addition approach like this, more stable anti-melt-contamination property can be obtained.

"Large particle size" refers to an average particle size of 0.03 to 0.10 μm, while "medium/small particle sizes" refer to an average particle size of less than 0.03 μm. If the average particle size of large hydrophobic silica particles exceeds 0.10 μm, fluidity will drop. If the average particle size is less than 0.03 μm, sufficient anti-melt-contamination property cannot be obtained. Medium/small hydrophobic silica particles have the effect of maintaining toner fluidity at a certain constant level or more.

The toner may have, in addition to fine hydrophobic silica particles, fine particles of magnetic powder, alumina, talc, clay, calcium carbonate, magnesium carbonate, titanium oxide, various resins, etc. adhered as external additives for the purpose of controlling fluidity, charging property, cleaning property, storage stability and other characteristics of the toner.

Methods to adhere the above fine particles to toner particles include mixing and agitating using a turbine mixer, Henschel mixer, super mixer or other general mixers.

Next, the heat-pressure type fuser used in the image forming method proposed by the present invention is explained. As mentioned above, use of a toner containing cycloolefin copolymer resins as binder resins will easily cause wrapping at a heat-pressure type fuser. After focusing on the fusing member and arduously studying ways to prevent wrapping at a heat-pressure type fuser when a toner containing cycloolefin copolymer resins is used, the inventor found that use of a fusing member having a PBI-containing surface layer would prevent wrapping, and also revealed that PBI had excellent releasing property particularly with respect to cycloolefin copolymer resins.

In the present invention, a heat-pressure type fuser equipped with a fusing member having a PBI-containing surface layer is needed. Of course, PBI can also be contained in the surface of the pressure roll not contacting toner, as it can enhance heat resistance and wear resistance. The fusing member generally has a roll or belt shape.

PBI is a super-heat-resistant, high-functional engineering plastic given by the general formula below, and heat-pressure type fusers using PBI are disclosed in Japanese Official Gazettes of Patent Nos. 2984404 and 3261166, among others.

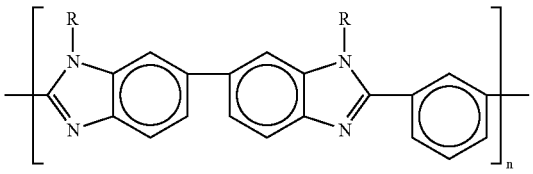

[In the formula, R indicates a hydrogen atom or alkyl group.]

PBI provides significantly higher heat resistance compared with PTFE or silicone rubber traditionally used to form the surface of fusing members. As a result, PBI allows setting of higher heat-roll temperatures, which contributes to higher copying speeds. PBI also offers excellent wear resistance and thus works as an ideal material for this roll, under which transfer papers pass at high speed. The number-average molecular weight of PBI used in the present invention should preferably be in a range of 2000 to 100000, or more preferably in a range of 5000 to 30000.

The PBI-containing surface layers of fusing members used in the heat-pressure type fusers of electrophotographic copiers and printers may comprise PBI alone, and other materials can also be added in the cases explained below. In any case, however, the content of PBI should preferably be 50 percent by weight or more. If the PBI content is less than 50 percent by weight, the beneficial characteristics of PBI—namely, heat resistance, wear resistance and releasing property with respect to cycloolefin copolymer resins—cannot be fully exhibited.

For example, PBI has slightly lower coefficients of compressive elasticity and tensile elasticity than some other materials, and thus sometimes it stretches and shrinks depending on the fusing conditions. In this case, heat-resistant resins offering higher modulus of elasticity, such as polyimide, can be added to increase the overall modulus of elasticity.

Also, high-molecular weight fluorine compounds or low-molecular weight fluorine compounds can be added if higher releasing property is required.

The aforementioned high-molecular weight fluorine compounds refer to single polymers or copolymers of monomers containing fluorine, or copolymers of monomers containing fluorine with other monomers. The said high-molecular weight fluorine compounds include polytetrafluoroethylene, polytrifluorochloroethylene, polyvinyl fluoride, polyvinylidene fluoride, polydichlorodifluoroethylene, etc. Of these, use of polytetrafluoroethylene is preferred.

The low-molecular fluorine compounds used in the present invention refer to inorganic or organic compounds containing fluorine atoms. Preferred low-molecular fluorine compounds are fluorinated hydrocarbons having a carbon atom number of up to 20. The aforementioned fluorinated hydrocarbons may be substituted by other functional groups such as alkoxy groups, alkenyl groups, aryl groups, oxy groups, hydroxyl groups, carboxyl groups, acyl groups, amino groups, nitro groups and halogen groups.

Also in the present invention, the aforementioned high-molecular weight fluorine compounds and low-molecular weight fluorine compounds can be simultaneously contained in the PBI-containing surface layer of the fusing member.

Furthermore in the present invention, fillers for internal addition may be contained in the PBI-containing surface layer of the fusing member besides the aforementioned fluorine compounds. By containing fillers for internal addition in the PBI-containing surface layer of the fusing member, the self-lubrication property and electrical conductivity of PBI can be improved. Appropriate fillers for internal addition include SIC, various metal powders and carbons such as graphite. Improved self-lubrication property of PBI will improve the passing property of copy papers between the fusing members, while improved electrical conductivity will prevent generation and accumulation of electrostatic charge resulting from frictional actions among the fusing member, transfer papers and toner.

Also, PBI has a very hard surface as indicated by 110 on the Rockwell hardness K scale. If this high hardness is a problem, other binder resin substances can be added to the PBI-containing surface layer to improve elasticity and surface hardness. Improved elasticity and surface hardness will add degrees of freedom to the contact area or nip width between the fusing members, thereby making it possible to control toner fusing efficiency. Appropriate binder resin substances include HTV (High-Temperature Vulcanized) silicone rubber, RTV (Room-Temperature Vulcanized) silicone rubber and LTV (Low-Temperature Vulcanized) silicone rubber.

The following explains, with the help of figures, examples of the fusing member having a PBI-containing surface layer, which comprises the heat-pressure type fuser used in the image forming method proposed by the present invention. Note, however, that the scope of the present invention is not limited to these examples.

FIG. 1 shows a roll-type fusing member of a heat-pressure type fuser. In this figure, the fusing roll (1) has a PBI-containing surface layer (2) formed on the surface of an aluminum core tube (3), and also has a heat source (4) at the center for fusing toner. A pressure roll (5) is provided in a manner facing the fusing roll, and these rolls rotate in the direction of arrows. Fusing is implemented by way of inserting a transfer paper (6), on which a toner image (7) is formed, between the fusing roll and pressure roll.

Figure 2:
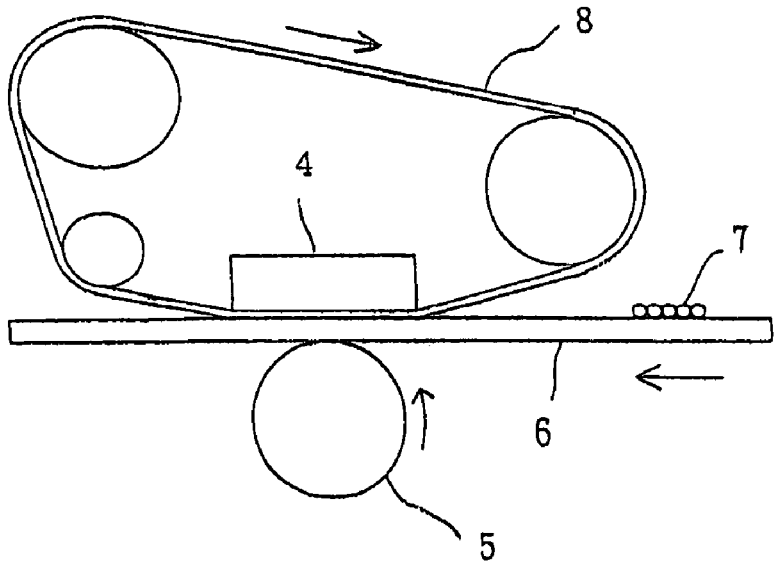
FIG. 2 provides a schematic diagram of a heat-pressure type fuser equipped with a belt-type fusing member, as used in the present invention.

FIG. 2 shows a belt-type fusing member. In the figure, a belt (8) made of PBI film (or film produced by forming a PBI-containing surface layer on a base film such as polyimide film) is bridged over a support roll and a driving roll in such a way that it will rotate in the direction of arrows. A heat source (4) is provided on the back of the belt in contact with the belt, and a pressure roll (5) is provided in a position facing the heat source. Fusing is implemented by way of inserting a transfer paper (6), on which a toner image (7) is formed, between the pressure roll (5) and the belt (8) that moves between the heat source (4) and pressure roll.

In the present invention, the fusing member having a PBI-containing surface layer as used in the heat-pressure type fuser may be manufactured by adding other substances, as necessary, to a solution consisting of PBI and solvent to achieve uniform dissolution, and then coating the PBI solution over a core tube or flexible belt. In other words, a desired fusing member can be obtained by dipping a core tube or belt in a PBI solution or spraying the solution over the surface of the core tube/belt to coat the core tube/belt with PBI, and then drying the solvent. Examples of the above solvent include N,N-dimethyl acetamide, N,N-dimethyl formamide, dimethyl sulfoxide, N-methyl-2-pyrrolidone and other solvents commonly used in the production of PBI dry spinning solutions. Among these, N,N-dimethyl acetamide and N-methyl-2-pyrrolidone are particularly desirable. In the case of a belt-type fusing member, the belt itself may be made of a film containing PBI, as shown in FIG. 2.

The fusing member used in the heat-pressure type fuser proposed by the present invention can also be produced by sinter-molding a mixture containing PBI into a cylinder shape or processing a sinter-molded material into a cylinder shape. Although PBI is a thermoplastic resin, its melting point is higher than its decomposition point, and thus PBI cannot be molded by the melt extrusion method. Therefore, a powder form of PBI, with other materials added, must be sintered to obtain a molded shape.

Use of PBI will achieve higher heat resistance and wear resistance than the members traditionally used in heat-pressure type fusers. It will also ensure a very long life of the fusing member and prevent wrapping at the fuser even when a toner containing cycloolefin copolymer resins with high fracture strength as main binder resins is used. This will allow the setting temperature of the fusing member contacting toner to be higher. This, coupled with the excellent releasing property of PBI with respect to cycloolefin copolymer resins, will contribute to higher copying speeds.

Also, it is desirable to use PBI that is a hydrophobicized polybenzimidazole (hereinafter referred to as "N-PBI"). Non-hydrophobicized PBI tends to absorb moisture when the printer is not in use, and release moisture when the printer is in use. Because of degradation resulting from repeated moisture absorptions and releases, non-hydrophobicized PBI has a shorter life and is less suitable for use in the fusing member compared with N-PBI. N-PBI can be selected from among those compounds given by the aforementioned general formula with R representing an alkyl group. Among these, $CH_3$ or $C_2H_5$ are particularly suitable.

EXAMPLES

The present invention is explained based on examples and comparative examples. Note, however, that the present invention is not limited to these examples.

<Production of Cycloolefin Copolymer Resins>

The following low molecular weight component, medium molecular weight component and high molecular weight component were melted and blended at the prescribed ratios and then pelletized to obtain cycloolefin copolymer resins. All components used the TOPAS series manufactured by Ticona GmbH, in which residual solvents were fully eliminated.

Low molecular weight component (product number: TM): Mw 7000

Medium molecular weight component (product number: 8007): Mw 80000

High molecular weight component (product number: TB): Mw 140000

<Production of Cycloolefin Copolymer Resin A>

TM, 8007 and TB listed above were melted and blended at the ratio of 34 percent by weight, 10 percent by weight and 56 percent by weight, respectively, and then pelletized to obtain cycloolefin copolymer resin A.

<Production of Cycloolefin Copolymer Resin B>

TM, 8007 and TB listed above were melted and blended at the ratio of 62 percent by weight, 10 percent by weight and 28 percent by weight, respectively, and then pelletized to obtain cycloolefin copolymer resin B.

<Production of Cycloolefin Copolymer Resin C>

8007 and TB listed above were melted and blended at the ratio of 20 percent by weight and 80 percent by weight, respectively, and then pelletized to obtain cycloolefin copolymer resin C.

<Production of Toners>

Example 1

Production of Toner A

| | |
|---|---|
| Cycloolefin copolymer resin A | 84 weight parts |
| Polypropylene wax (VISCOL 660P manufactured by Sanyo Chemical Industries Ltd., having a melting point of 137° C.) | 7 weight parts |
| Boron complex (LR-147 manufactured by Japan Carlit Co., Ltd.) | 2 weight parts |
| Carbon black (REGAL 330R manufactured by Cabot Specialty Chemicals Inc.) | 7 weight parts |

The materials blended by the aforementioned ratio were mixed in a super mixer, melted and kneaded by a twin screw extruder, pulverized by a jet mill, and then classified by a dry airflow classifier to obtain toner particles of a volume-average particle size of 9 μm.

Then, the obtained toner particles were mixed with 0.3 percent by weight of large hydrophobic silica particles (NA-50Y manufactured by Nippon Aerosil Co., Ltd., having a particle size of 0.050 μm) and 1.0 percent by weight of medium hydrophobic silica particles (H2000/4M manufactured by Wacker Chemie GmbH, having a particle size of 0.015 μm), and then mixed for 4 minutes in a Henschel mixer at a peripheral speed of 40 m/sec to obtain toner A. The concentration of decalin residues in toner particles was 95 ppm.

Example 2

Production of Toner B

Toner B was obtained in the same manner as in Example 1, except that cycloolefin copolymer resin B was used instead of cycloolefin copolymer resin A. The concentration of decalin residues in toner particles was 250 ppm.

Example 3

Production of Toner C

Toner C was obtained in the same manner as in Example 1, except that cycloolefin copolymer resin C was used instead of cycloolefin copolymer resin A. The concentration of decalin residues in toner particles was 75 ppm.

Example of Comparative Toner Production
Production of Toner D

Toner D was obtained in the same manner as in Example 1, except that polyester resin (FC-1142 manufactured by Mitsubishi Rayon Co., Ltd.) was used instead of cycloolefin copolymer resin A.

<Production of Fusing Rolls with a PBI-Containing Surface Layer>

<Production of Fusing Roll a>

N-PBI (a product manufactured by Clariant (Japan) K.K. was dissolved into N,N-dimethyl acetamide to obtain a coating solution. The obtained coating solution was sprayed over the surface of an aluminum core tube of 20 mm in diameter. Next, the coating film was sintered at 320° C. to obtain fusing roll a having a N-PBI film of 20 μm in thickness.

<Production of Fusing Roll b>

N-PBI (a product manufactured by Clariant (Japan) K.K. and polyimide (VESPEL manufactured by DuPont) were dissolved into N,N-dimethyl acetamide to obtain a coating solution. The obtained coating solution was sprayed over the surface of an aluminum core tube of 20 mm in diameter. Next, the coating film was sintered at 320° C. to obtain fusing roll b having a N-PBI film of 20 μm in thickness.

Examples 4 to 6 and Comparative Example 1

Each of the toners obtained by aforementioned Examples 1 to 3 and the comparative toner (toners A to D) was mixed with a silicone-coated ferrite carrier (average particle size: 80 μm) to a weight ratio of 5 to 95 between toner and carrier to obtain a two-component developer. Each of the obtained developers was installed in a copier (AR-S400 manufactured by Sharp Corporation) equipped with aforementioned fusing roll a coated with N-PBI, and a A4 document with an image ratio of 5% was copied onto a maximum of 100,000 A4 transfer papers at a temperature of 25° C. and humidity of 50% to evaluate image density (ID), back ground fogging (BG), offset and wrapping, carrier contamination, toner consumption, and transfer efficiency.

Example 7

Toner A proposed by aforementioned Example 1 was mixed with a silicone-coated ferrite carrier (average particle size: 80 μm) to a weight ratio of 5 to 95 between toner and carrier to obtain a two-component developer. The obtained developer was installed in a copier (AR-S400 manufactured by Sharp Corporation) equipped with aforementioned fusing roll b coated with N-PBI and polyimide, and a A4 document with an image ratio of 5% was copied onto a maximum of 100,000 A4 transfer papers at a temperature of 25° C. and humidity of 50% to evaluate image density (ID), back ground fogging (BG), offset and wrapping, carrier contamination, toner consumption, and transfer efficiency.

Comparative Examples 2 to 4

Each of toner A and C provided by aforementioned Examples 1 and 3 and comparative toner D was mixed with a silicone-coated ferrite carrier (average particle size: 80 μm) to a weight ratio of 5 to 95 between toner and carrier to obtain a two-component developer. Each of the obtained developers was installed in a copier (AR-S400 manufactured by Sharp Corporation) equipped with a PTFE fusing roll on the toner-contacting side, and a A4 document with an image ratio of 5% was copied onto a maximum of 100,000 A4 transfer papers at a temperature of 25° C. and humidity of 50% to evaluate image density (ID), back ground fogging (BG), offset and wrapping, carrier contamination, toner consumption, and transfer efficiency.

The evaluation methods are explained below.

1. Image density (ID) was measured by a Macbeth reflective densitometer (RD-914) in an area of solid image.
2. Back Ground Fogging (BG) was measured by a colormeter (ZE2000 manufactured by Nippon Denshoku Industries Co., Ltd.) as whiteness in a non-printed area, and the result was indicated as a difference in whiteness before and after copying.
3. Offset and Wrapping around the roll were checked visually based on the following criteria:
   A: Offset and wrapping did not occur.
   B: Printed image exhibits indication of high-temperature or low-temperature offset.
   C: Obvious offset or wrapping occurred.
4. Carrier contamination (percent by weight) was measured by placing the developer in a surface active agent aqueous solution to wash away the toner, drying the remaining carrier, and then measuring by a carbon analyzer (EMIA-110 manufactured by HORIBA, Ltd.) the carbon weight of an unused carrier and that of a carrier subjected to printing durability test to obtain the percent by weight of carbon attached to the carrier based on the difference between the measured weights.
5. Toner consumption was obtained from the decrease in the toner weight.
6. Transfer efficiency was obtained using the following formula, where A and B indicate consumed toner and recovered toner, respectively:

$$[(A-B)/A]\times 100(\%)$$

The evaluation results are shown in Table 1.

TABLE 1

| | | Example 4 | Example 5 | Example 6 | Example 7 | Comparative Example 1 | Comparative Example 2 | Comparative Example 3 | Comparative Example 4 |
|---|---|---|---|---|---|---|---|---|---|
| Binder resin * | | COC | COC | COC | COC | PES | COC | COC | PES |
| Toner | | A | B | C | A | D | A | C | D |
| Fusing roll | | PBI | PBI | PBI | PBI/Imide | PBI | PTFE | PTFE | PTFE |
| ID | Initial | 1.48 | 1.53 | 1.41 | 1.45 | 1.42 | Could not be evaluated due to wrapping | Could not be evaluated due to wrapping | 1.44 |
| | After 20,000 pages | 1.47 | 1.55 | 1.42 | 1.46 | 1.40 | | | 1.44 |
| | After 40,000 pages | 1.47 | 1.53 | 1.40 | 1.46 | 1.42 | | | 1.43 |
| | After 60,000 pages | 1.46 | 1.52 | 1.42 | 1.47 | 1.35 | | | 1.36 |
| | After 80,000 pages | 1.48 | 1.54 | 1.42 | 1.45 | 1.31 | | | 1.34 |
| | After 100,000 pages | 1.47 | 1.55 | 1.41 | 1.45 | 1.25 | | | 1.27 |
| BG | Initial | 0.33 | 0.38 | 0.41 | 0.38 | 0.52 | Could not be evaluated due to wrapping | Could not be evaluated due to wrapping | 0.59 |
| | After 20,000 pages | 0.35 | 0.37 | 0.38 | 0.40 | 0.61 | | | 0.65 |
| | After 40,000 pages | 0.42 | 0.33 | 0.35 | 0.41 | 0.70 | | | 0.61 |
| | After 60,000 pages | 0.34 | 0.44 | 0.43 | 0.38 | 0.77 | | | 0.79 |
| | After 80,000 pages | 0.37 | 0.41 | 0.40 | 0.40 | 0.83 | | | 0.88 |
| | After 100,000 pages | 0.32 | 0.39 | 0.44 | 0.39 | 1.04 | | | 1.13 |
| Offset and wrapping | Initial | A | A | A | A | A | C | C | A |
| | After 20,000 pages | A | A | A | A | A | — | — | A |
| | After 40,000 pages | A | A | A | A | A | — | — | A |
| | After 60,000 pages | A | A | A | A | A | — | — | A |
| | After 80,000 pages | A | A | A | A | A | — | — | A |
| | After 100,000 pages | A | A | A | B | A | — | — | A |
| Carrier contamination | Initial | — | — | — | — | — | Could not be evaluated due to wrapping | Could not be evaluated due to wrapping | — |
| | After 20,000 pages | 0.12 | 0.15 | 0.11 | 0.13 | 0.22 | | | 0.26 |
| | After 40,000 pages | 0.14 | 0.19 | 0.16 | 0.13 | 0.32 | | | 0.35 |
| | After 60,000 pages | 0.17 | 0.19 | 0.16 | 0.15 | 0.38 | | | 0.40 |
| | After 80,000 pages | 0.17 | 0.22 | 0.15 | 0.16 | 0.44 | | | 0.48 |
| | After 100,000 pages | 0.18 | 0.23 | 0.17 | 0.19 | 0.49 | | | 0.52 |
| Toner consumption | Initial | — | — | — | — | — | Could not be evaluated due to wrapping | Could not be evaluated due to wrapping | — |
| | After 20,000 pages | 23.1 | 24.2 | 23.7 | 22.2 | 28.5 | | | 29.5 |
| | After 40,000 pages | 23.6 | 23.8 | 23.2 | 23.5 | 28.8 | | | 28.2 |
| | After 60,000 pages | 23.4 | 23.5 | 23.1 | 23.2 | 27.7 | | | 29.8 |
| | After 80,000 pages | 24.1 | 23.1 | 23.6 | 23.9 | 29.4 | | | 27.4 |
| | After 100,000 pages | 24.3 | 24.1 | 23.9 | 24.1 | 29.8 | | | 26.8 |
| Transfer efficiency | Initial | — | — | — | — | — | Could not be evaluated due to wrapping | Could not be evaluated due to wrapping | — |
| | After 20,000 pages | 93.2 | 92.1 | 92.6 | 89.2 | 84.1 | | | 85.1 |
| | After 40,000 pages | 91.9 | 91.3 | 90.1 | 90.1 | 85.9 | | | 84.3 |
| | After 60,000 pages | 90.4 | 92.4 | 88.2 | 88.6 | 82.4 | | | 81.6 |
| | After 80,000 pages | 91.2 | 90.5 | 89.9 | 89.4 | 80.1 | | | 79.1 |
| | After 100,000 pages | 90.6 | 89.7 | 90.2 | 90.3 | 78.5 | | | 77.5 |

* COC: Cycloolefin copolymer resin,
PES: Polyester resin

In Examples 4 to 7 and Comparative Example 1, visual check of fusing roll surface found no degradation due to continuous printing of many sheets.

In Comparative Examples 2 to 4, visual check of fusing roll surface found degradation due to wear in the locations passed by transfer papers.

<Evaluation Results>

As evident from Table 1, the image density in the initial state and until 100,000 sheets were printed was 1.40 or above in Examples 4 to 7, where back ground fogging was also 0.44 or less, suggesting that no problem will occur in practical copying operations. Offset and wrapping, BS onto the photoreceptor and contamination on the developing member were absent, and charge performance, fusing performance and durability posed no concerns. In Comparative Examples 1 and 4, lower image density, increased back ground fogging and various other problems were observed, which are assumed to have been caused by carrier contamination. In addition, toners using a cycloolefin copolymer resin resulted in fewer consumption and higher transfer efficiency compared with toners using a polyester resin.

In addition, wrapping around the fusing roll occurred early in Comparative Examples 2 and 3, and evaluation could not be continued. The results of Comparative Example 4 were roughly the same as those of Comparative Example 1, showing no benefit of using a PBI fusing roll when polyester resin is used.

From the above evaluation results, PBI is found effective when cycloolefin copolymer resins are used.

What is claimed is:

1. An electrophotographic toner used for an image forming method that utilizes a heat-pressure type fuser equipped with a fusing member having a surface layer containing polybenzimidazole, said electrophotographic toner comprising at least a cycloolefin copolymer resin as a binder resin, wherein said cycloolefin copolymer resin comprises a mixture of 0 to 75 percent by weight of a low molecular weight component having a weight-average molecular weight of less than 15,000, 5 to 25 percent by weight of a medium molecular weight component having a weight-average molecular weight of 15,000 to 100,000, and 20 to 95 percent by weight of a high molecular weight component having a weight-average molecular weight of more than 100,000.

2. The electrophotographic toner as described in claim 1, wherein said polybenzimidazole is a hydrophobic polybenzimidazole.

3. An electrophotographic toner containing a cycloolefin copolymer resin as a binder resin, wherein said cycloolefin copolymer resin comprises a mixture of 0 to 75 percent by weight of a low molecular weight component having a weight-average molecular weight of less than 15000, 5 to 25 percent by weight of a medium molecular weight component having a weight-average molecular weight of 15000 to 100000, and 20 to 95 percent by weight of a high molecular weight component having a weight-average molecular weight of more than 100000.

4. The electrophotographic toner as described in claim 1 or 3, wherein the content of cycloolefin copolymer resin in the binder resin is 50 percent by weight or more.

5. The electrophotographic toner as described in claim 1 or 2, which comprises a boron complex of the general formula below as a charge control agent:

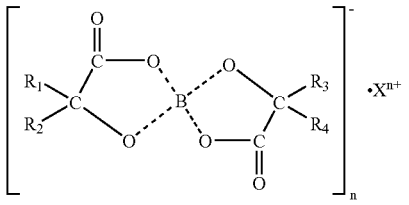

wherein $R_1$ and $R_4$ indicate hydrogen atoms, alkyl groups or substituted or non-substituted aromatic rings (including fused rings), while $R_2$ and $R_3$ indicate substituted or non-substituted aromatic rings (including fused rings). B indicates boron and $X^{n+}$ indicates a cation, where n is either 1 or 2.

6. The electrophotographic toner as described in claim 1 or 3, wherein the content of decalin in the toner contained as residual solvent in the cycloolefin copolymer resin is 500 ppm or less.

7. The electrophotographic toner as described in claim 1 or 3, wherein the toner is a full-color toner.

8. An image forming method which comprises supplying a transfer paper with a toner image formed by an electrophotographic toner that comprises a cycloolefin copolymer resin as a binder resin, to a heat-pressure type fuser equipped with a fusing member having a polybenzimidazole-containing surface layer, thereby fusing said toner image, wherein said cycloolefin copolymer resin comprises a mixture of 0 to 75 percent by weight of a low molecular weight component having a weight-average molecular weight of less than 15,000, 5 to 25 percent by weight of a medium molecular weight component having a weight-average molecular weight of 15,000 to 100,000, and 20 to 95 percent by weight of a high molecular weight component having a weight-average molecular weight of more than 100,000, and wherein the content of cycloolefin copolymer resin in the binder ranges from 50 percent by weight to 100 percent by weight.

9. The image forming method as described in claim 8, wherein said polybenzimidazole is a hydrophobic polybenzimidazole.

10. An image forming method which comprises supplying a transfer paper with a toner image formed by an electrophotographic toner that comprises, as a binder resin, a cycloolefin copolymer resin comprising a mixture of 0 to 75 percent by weight of a low molecular weight component having a weight-average molecular weight of less than 15000, 5 to 25 percent by weight of a medium molecular weight component having a weight-average molecular weight of 15000 to 100000, and 20 to 95 percent by weight of a high molecular weight component having a weight-average molecular weight of more than 100000, to a heat-pressure type fuser, thereby fusing said toner image.

11. The image forming method as described in claim 8 or 10, wherein the content of said cycloolefin copolymer resin in the toner is 50 percent by weight or more.

12. The image forming method as described in claim 8 or 10, wherein the toner comprises a boron complex of the general formula below as charge control agents:

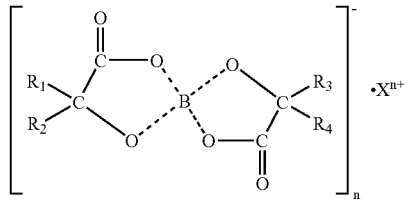

wherein, $R_1$ and $R_4$ indicate hydrogen atoms, alkyl groups or substituted or non-substituted aromatic rings (including fused rings), while $R_2$ and $R_3$ indicate substituted or non-substituted aromatic rings (including fused rings). B indicates boron and $X^{n+}$ indicates a cation, where n is either 1 or 2.

13. The image forming method as described in claim 8 or 10, wherein the content of decalin in the toner contained as residual solvent in the cycloolefin copolymer resin is 500 ppm or less.

14. The image forming method as described in claim 8 or 10, wherein the toner is a full-color toner.

15. The electrophotographic toner as described in claim 1 or 3 further comprising a coloring agent.

16. The electrophotographic toner as described in claim 15 further comprising a release agent.

17. The electrophotographic toner as described in claim 16 wherein the release agent is a wax.

* * * * *

UNITED STATES PATENT AND TRADEMARK OFFICE

CERTIFICATE OF CORRECTION

PATENT NO. : 7,378,209 B2
APPLICATION NO. : 10/529623
DATED : May 27, 2008
INVENTOR(S) : Yoshihito Suwa and Toru Nakamura It is certified that error appears in the above-identified patent and that said Letters Patent is hereby corrected as shown below:

In Column 8, Line 22, please delete “chargeing” and insert --charging--.

In Column 10, Line 43 (Approx.), please delete “SIC” and insert --SiC--.

Signed and Sealed this

Twenty-fifth Day of November, 2008

JON W. DUDAS
*Director of the United States Patent and Trademark Office*